US008910413B2

(12) United States Patent
Hillwig, Jr.

(10) Patent No.: US 8,910,413 B2
(45) Date of Patent: Dec. 16, 2014

(54) SIGHT PUSHING APPARATUS

(71) Applicant: James Gilbert Hillwig, Jr., Meadville, PA (US)

(72) Inventor: James Gilbert Hillwig, Jr., Meadville, PA (US)

( * ) Notice: Subject to any disclaimer, the term of this patent is extended or adjusted under 35 U.S.C. 154(b) by 0 days.

(21) Appl. No.: 13/947,666

(22) Filed: Jul. 22, 2013

(65) Prior Publication Data

US 2014/0230304 A1 Aug. 21, 2014

Related U.S. Application Data

(60) Provisional application No. 61/766,947, filed on Feb. 20, 2013.

(51) Int. Cl.
*F41G 1/10* (2006.01)
*F41G 1/54* (2006.01)

(52) U.S. Cl.
CPC . *F41G 1/545* (2013.01); *F41G 1/10* (2013.01)
USPC ..... 42/143

(58) Field of Classification Search
CPC ..... F41G 1/06; F41G 1/10; F41G 1/545
USPC ..... 42/90, 111, 143
See application file for complete search history.

(56) References Cited

U.S. PATENT DOCUMENTS 2,599,839 A * 6/1952 Keifer, Jr. ..... 42/139
5,864,957 A * 2/1999 Small ..... 42/111

FOREIGN PATENT DOCUMENTS

GB 9059 * 0/1915

* cited by examiner

*Primary Examiner* — Stephen M Johnson
(74) *Attorney, Agent, or Firm* — Dale J. Ream

(57) ABSTRACT

A sight pushing apparatus for use in adjusting a gun slide sight element includes a block member having exterior side, front, rear, top, and bottom walls. The block member defines an interior area having an upper cavity extending between the opposed front and rear walls and a lower cavity extending between the opposed front and rear walls. The lower cavity includes a first internal side wall and an opposed second side wall configured to receive the gun slide therebetween. The sight element of the gun slide is situated in the upper cavity when the gun slide is received in the lower cavity. A pushing member selectively extends through a side wall into the upper cavity. A jaw member is situated in the upper cavity adjacent the sight element, the jaw member configured to bear against the sight element when urged by the pushing member.

15 Claims, 8 Drawing Sheets

SIGHT PUSHING APPARATUS

REFERENCE TO RELATED APPLICATIONS

This application claims the priority date of the U.S. Provisional patent application Ser. No. 61/766,947 filed Feb. 20, 2013 Universal Sight Pusher with Hardened Pusher On Hardened Rail with Swivel Tip Holding Screws.

BACKGROUND OF THE INVENTION

This invention relates generally to gun repair devices and, more particularly, a gun sight pushing apparatus that enables a sight element on a gun slide of a handgun to be laterally adjusted into proper alignment or to be completely removed.

The sighting element mounted at the front or rear of a gun barrel may become misaligned, such as from an inadvertent impact or just due to wear and tear. Unfortunately, a misaligned sight element will result in missed shots. Realigning a damaged sight requires moving the sight element to the left or right. Alternatively, the entire sight element must be removed and replaced. Either option may be a difficult task, especially for a novice or for one without proper tools.

Therefore, it would be desirable to have a sight pushing apparatus capable of holding a gun slide securely while adjusting the position of a sight element or while removing the sight element altogether. Further, it would be desirable to have a sight pushing apparatus in which a user has incremental control over pushing a sight element laterally with regard to gun slide.

SUMMARY OF THE INVENTION

A sight pushing apparatus for use in adjusting the position of a sight element on a gun slide of a handgun according to the present invention includes a block member having a generally solid construction that includes opposed exterior side walls, opposed exterior front and rear walls, and opposed exterior top and bottom walls. The block member defines an interior area that includes an upper cavity extending between the opposed front and rear walls and a lower cavity extending between the opposed front and rear walls and in communication with the upper cavity and with an area outside the interior area. The lower cavity includes a first internal side wall and an opposed second side wall configured to receive the gun slide into the lower cavity between the first and second internal side walls. The sight element of the gun slide is situated in the upper cavity when the gun slide is received in the lower cavity. A pushing member is configured to extend through a side wall into the upper cavity. A jaw member is situated in the upper cavity adjacent the sight element of the gun slide, the jaw member configured to bear against the sight element when urged by the pushing member.

Therefore, a general object of this invention is to provide a sight pushing apparatus for use with a gun slide having a sight element that selectively urges the sight element to move laterally or be removed from the gun slide.

Another object of this invention is to provide a sight pushing apparatus, as aforesaid, that receives a gun slide of a handgun and provides vice-like locking means to hold the gun slide while a sight element thereon is adjusted or removed.

Still another object of this invention is to provide a sight pushing apparatus, as aforesaid, having a pushing member selectively inserted to urge a gun slide sighting element to move laterally until properly aligned or completely removed.

Yet another object of this invention is to provide a sight pushing apparatus, as aforesaid, having a guide rod on which a jaw member slides in order to maintain proper alignment when being urged to push on a gun slide sighting element.

A further object of this invention is to provide a sight pushing apparatus, as aforesaid, having a slot that enables a user to visually position a gun slide before urging the sight element to be adjusted or removed.

A still further object of this invention is to provide a sight pushing apparatus, as aforesaid, that is easy and user-friendly to use.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
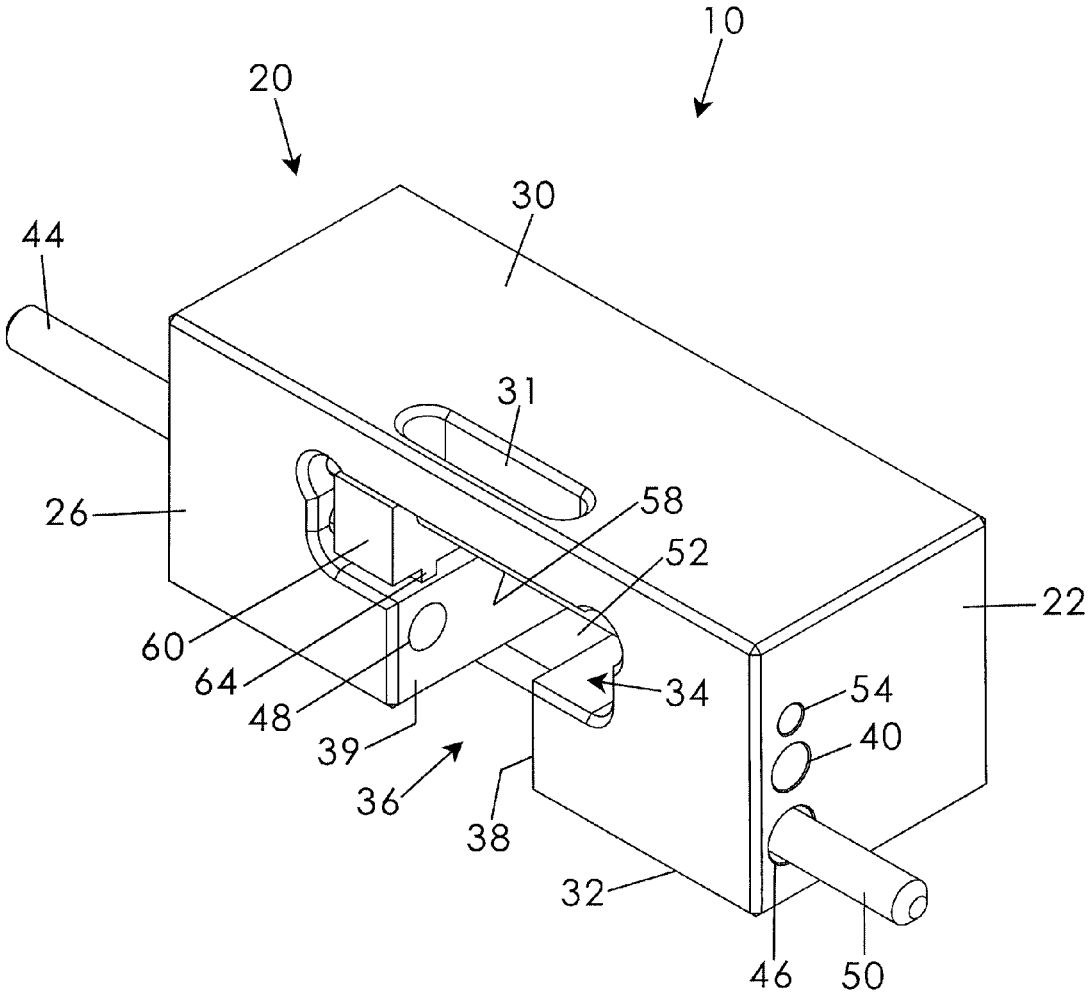
FIG. 1 is a perspective view of a sight pushing apparatus according to a preferred embodiment of the present invention.

A sight pushing apparatus according to a preferred embodiment of the present invention will now be described in detail with reference to FIGS. 1 to 8*b* of the accompanying drawings. The sight pushing apparatus 10 includes a block member 20, a pushing member 44, a holding member 50, a jaw member 60, and a guide rod 58.

The block member 20 is a generally rectangular structure having a generally solid construction except as described below. More particularly, the block member 20 includes opposed exterior first 22 and second 24 side walls and opposed exterior front 26 and rear 28 walls extending between front and rear edges of respective first 22 and second 24 side walls. Further, opposed exterior top 30 and bottom 32 walls extend between upper and lower edges of respective first 22 and second 24 side walls.

The block member 20 defines an interior area having an upper cavity 34 extending between the opposed front 26 and rear 28 walls. Stated another way, the upper cavity 34 is a through-bore through the block member 20 that yields an open space that is open to both the front and rear. The interior area also defines a lower cavity 36 extending between opposed front 26 and rear 28 walls, the lower cavity being in operative communication with the upper cavity 34. The lower cavity 36 also extends through the bottom wall 32 of the block member 20 and, as such, is in communication with an area outside the interior area. In other words, the lower cavity defines an opening through the bottom wall 32.

The block member 20 includes a first internal side wall 38 situated in the lower cavity 36 and an opposed second internal side wall 39 situated in the lower cavity 36. The first 38 and second 39 internal side walls are configured to receive the gun slide 12 therebetween. The sight element 14 is situated in the upper cavity 34 when the gun slide 12 is received between the first 38 and second 39 internal side walls for reasons that will be explained more fully later.

Figure 8A:
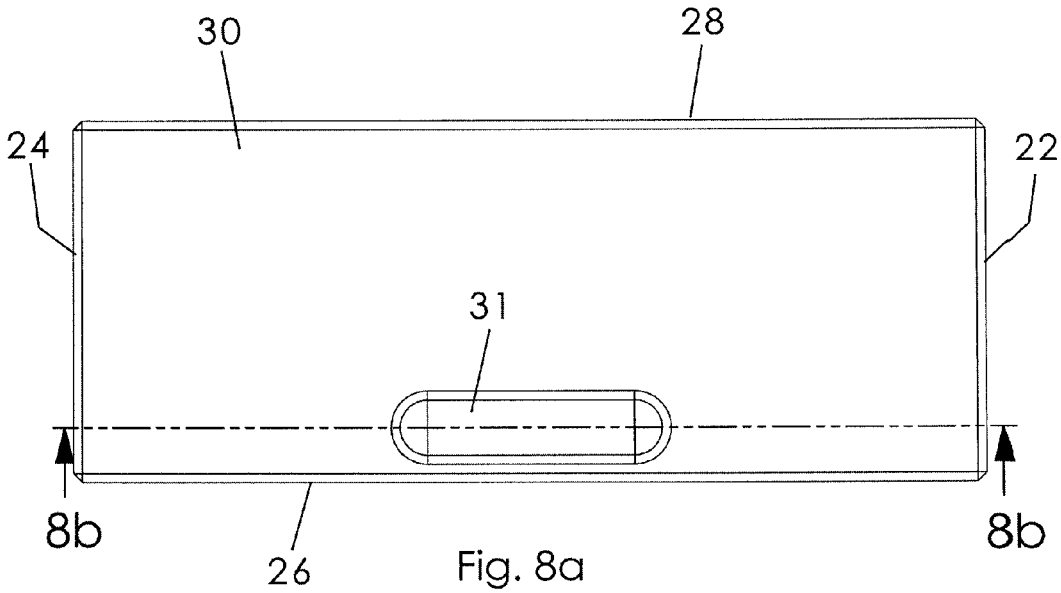
FIG. 8*a* is a top view of the sight pushing apparatus as in FIG. 1.
Figure 8B:
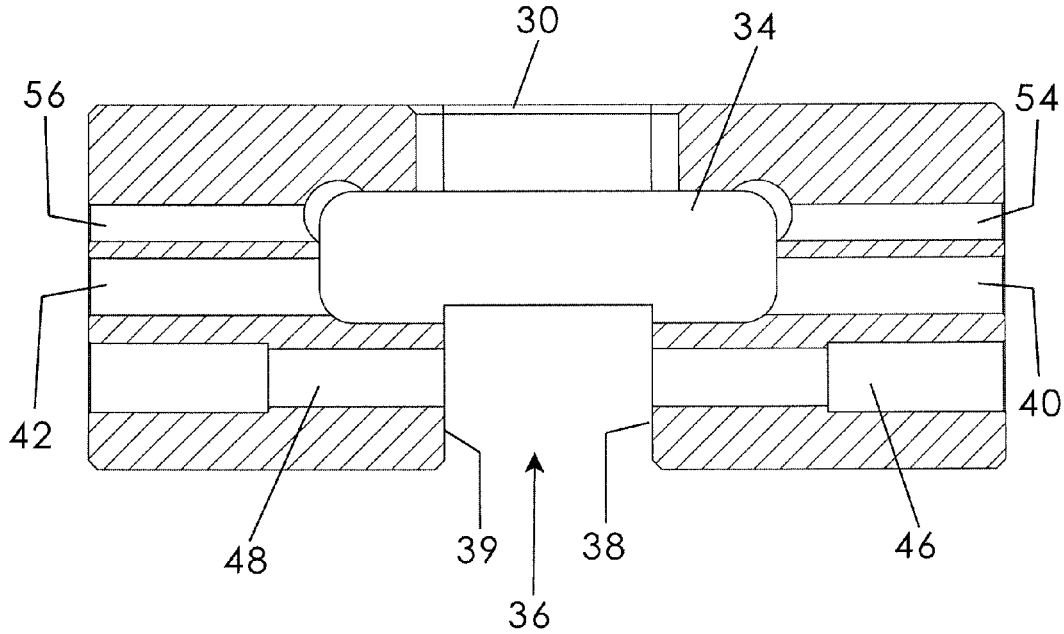
FIG. 8*b* is a sectional view taken along line 8*b*-8*b* of FIG. 8*a.*

As best shown in FIG. 8*b*, the block member 20 defines a plurality of bores as described below. The block member 20 defines a first bore 40 extending from the first side wall 22 into communication with the upper cavity 34. It is understood that while the drawings show an entrance opening in the first side wall 22 that is designated as the first bore 40, the first bore 40 continues through the solid construction of the block member 20 until it opens into communication with the upper cavity 34. The same goes for other bores as will be described below. Similarly, the block member 20 defines a second bore 42 extending from the second side wall 24 into communication with the upper cavity 34.

The sight pushing apparatus 10 includes a pushing member 44 having an elongate cylindrical configuration. The pushing member 44 is selectively received in either the first bore 40 or second bore 42. As will be described later, the pushing member 44 may first be inserted into the first bore 40 so as to urge the sight element 14 in a first direction and inserted into the second bore 42 so as to urge the sight element 14 in a second (opposite) direction. The pushing member 44 may be urged along the first bore 40 or second bore 42 in various ways, including being tapped with a hammer, with a turning tool such as a screwdriver, or with a power tool such a battery powered drill.

The sight pushing apparatus 10 includes a jaw member 60 situated in the upper cavity 34 adjacent the sight element 14 of a gun slide 12 when the gun slide 12 is received in the lower cavity 36. The jaw member 60 includes a configuration that is complementary to a configuration of the sight element so that the jaw member 60 efficiently bears against the sight element 14. The jaw member 60 is laterally movable inwardly or outwardly when urged by the pushing member 44. The sight element 14, therefore, is likewise moved inwardly or outwardly by the jaw member 60 when the jaw member 60 is urged by the pushing member 44.

The block member 20 further defines a third bore 46 extending from the first side wall 22 into communication with the lower cavity 36. Similarly, the block member 20 further defines a fourth bore 48 extending from the second side wall 24 into communication with the lower cavity 36. Again, the drawings illustrate openings into the first 22 and second 24 side walls, it being understood that the bores, respectively extend through the generally solid block member 20 until it opens into communication with the lower cavity 36. In like manner, the block member 20 further defines a fourth bore 48 extending from the second side wall 24 into communication with the lower cavity 36. It is understood, that the third 46 and fourth 48 bores are positioned identically as they will be used in like manner as described below.

The sight pushing apparatus 10 includes a holding member 50 having an elongate cylindrical configuration. The holding member 50 is selectively received in either the third bore 42 or fourth bore 48 and movable therealong into the lower cavity 36 so as to press against the gun slide 12 when the gun slide 12 is received in the lower cavity 36 as described above. When inserted in this manner, the gun slide 12 may be held in a friction fit or press fit manner against a respective first 38 or second 39 internal side wall.

The jaw member 60 may define a guide channel 62 extending horizontally between its side walls. Correspondingly, the block member 20 defines a fifth bore 54 extending from the first side wall 22 into communication with the upper cavity 34. In like manner, the block member 20 defines a sixth bore 56 extending from the second side wall 24 into communication with the upper cavity 34. The sight pushing apparatus 10 also includes a guide rod 58 having an elongate and cylindrical configuration selectively received in the fifth bore 54 or sixth bore 56 and movable therealong into the upper cavity 34 and through the jaw member guide channel 62. The jaw guide channel 62 is configured such that the jaw member 60 is movable along the guide rod 58 as the jaw member 60 is urged laterally by the pushing member 44 as described above. It is understood that the guide rod 58 is effective to keep the jaw member 60 level and stable as the jaw member 60 is pushed from the side by the pushing member 44 to move the sight element 14 relative to the gun slide 12.

Figure 2:
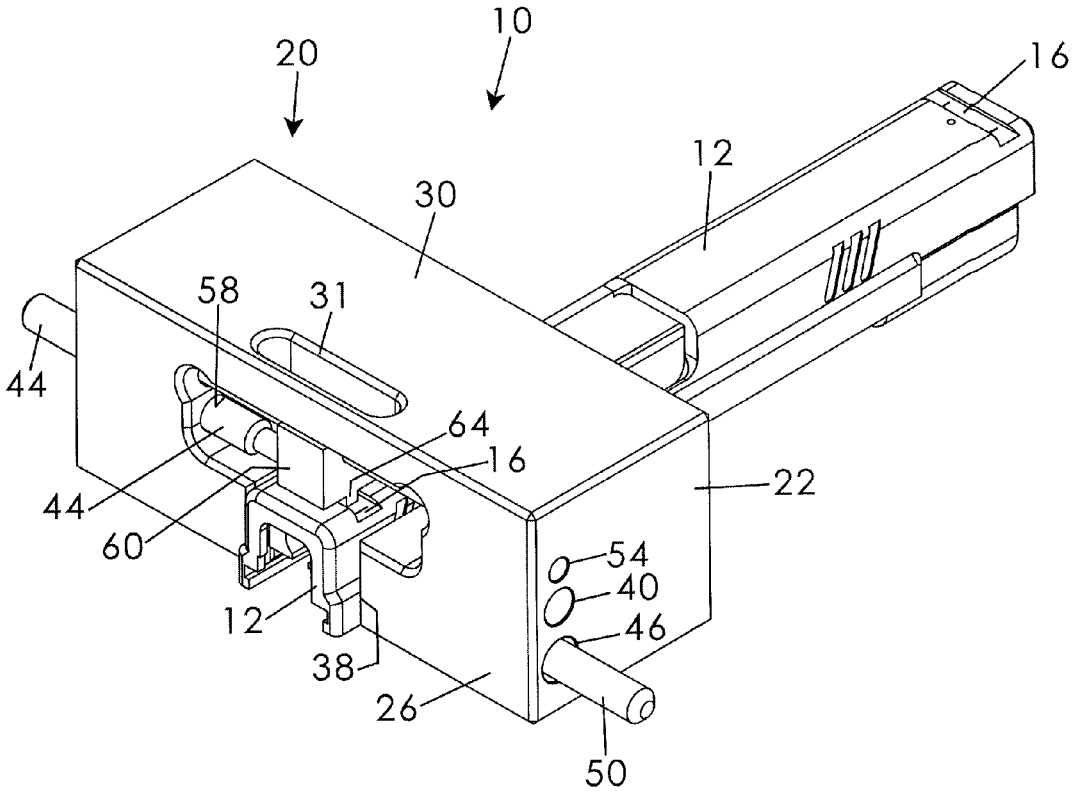
FIG. 2 is a perspective view of the sight pushing apparatus as in FIG. 1 in use with a gun slide.
Figure 3:
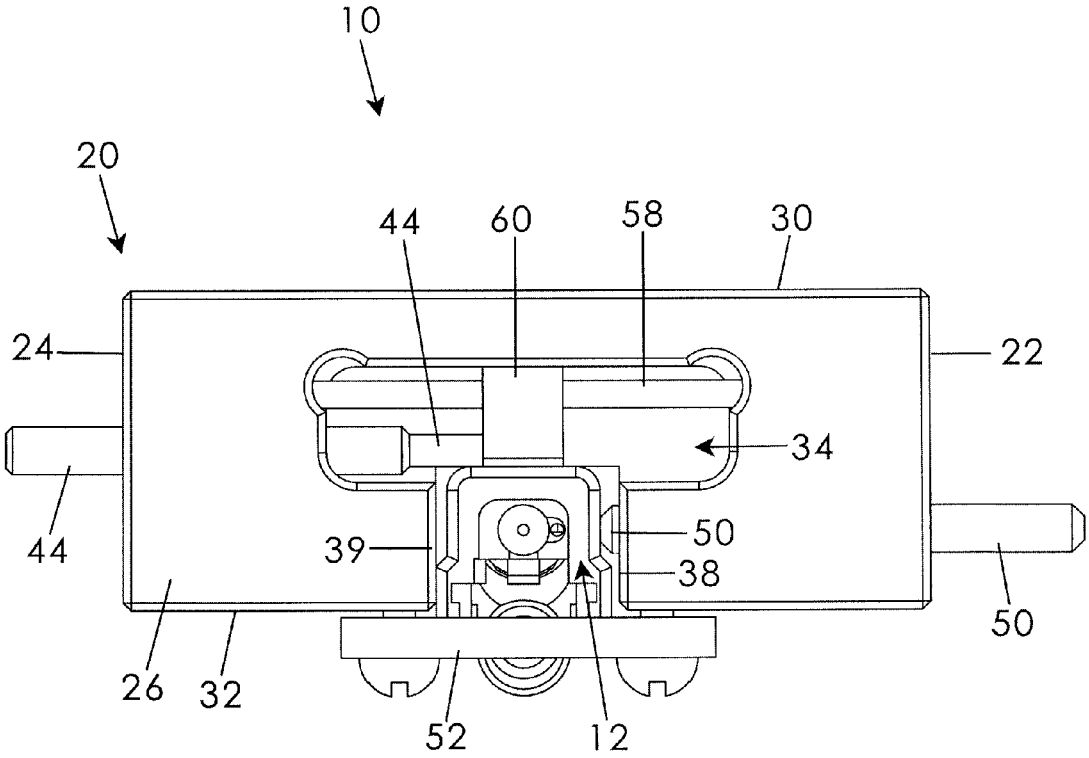
FIG. 3 is a front view of the sight pushing apparatus as in FIG. 2.
Figure 4:
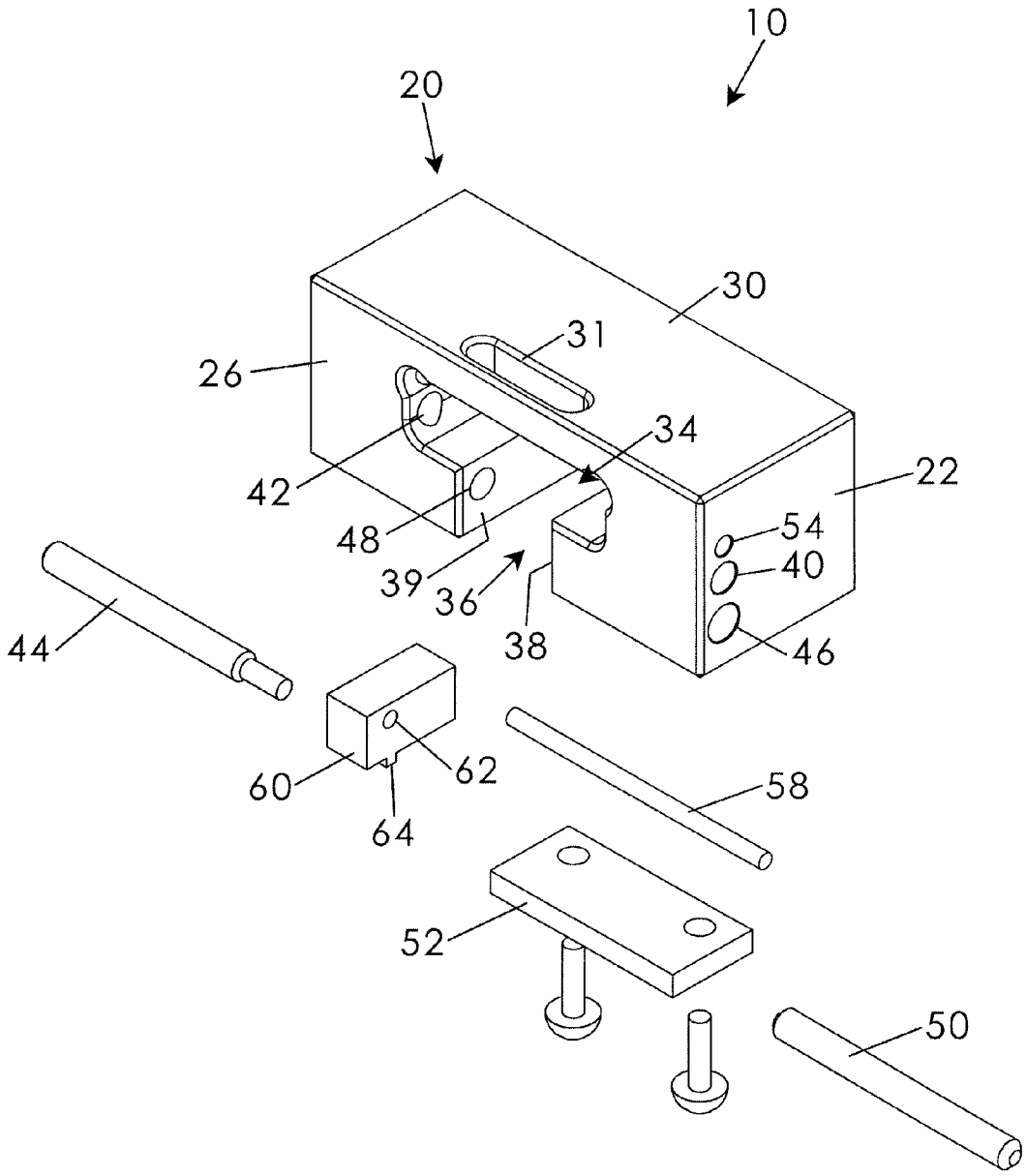
FIG. 4 is an exploded view of the sight pushing apparatus as in FIG. 1.
Figure 5:
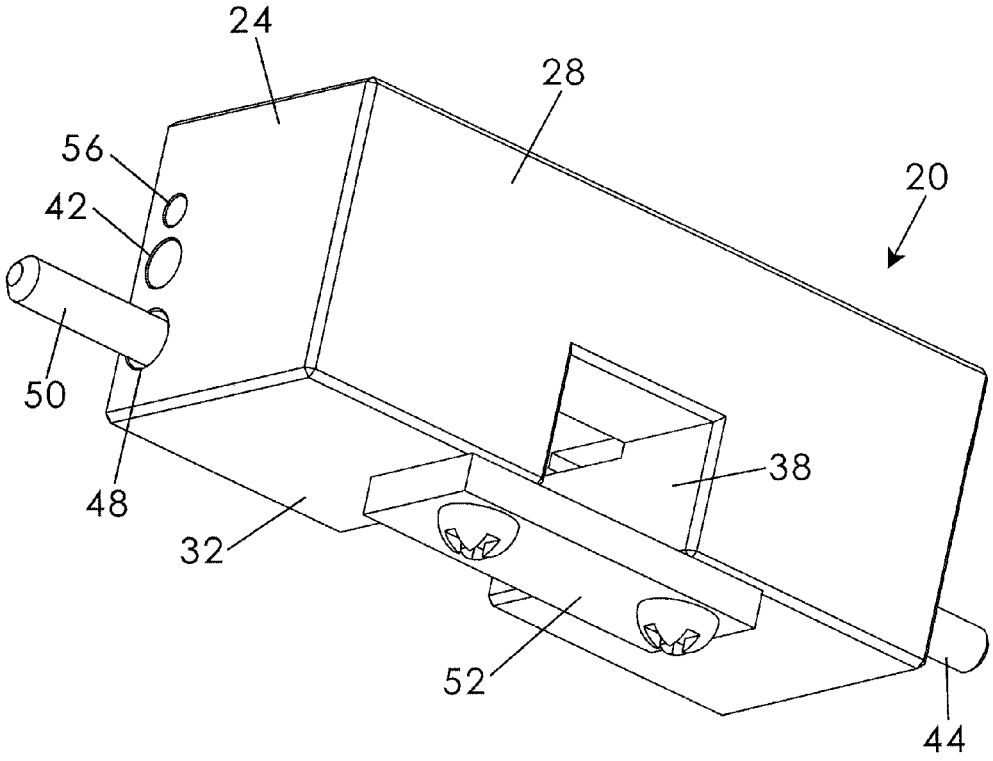
FIG. 5 is a perspective view of the apparatus taken from a rear and lower angle and from the opposite side compared to FIG. 1.
Figure 6:
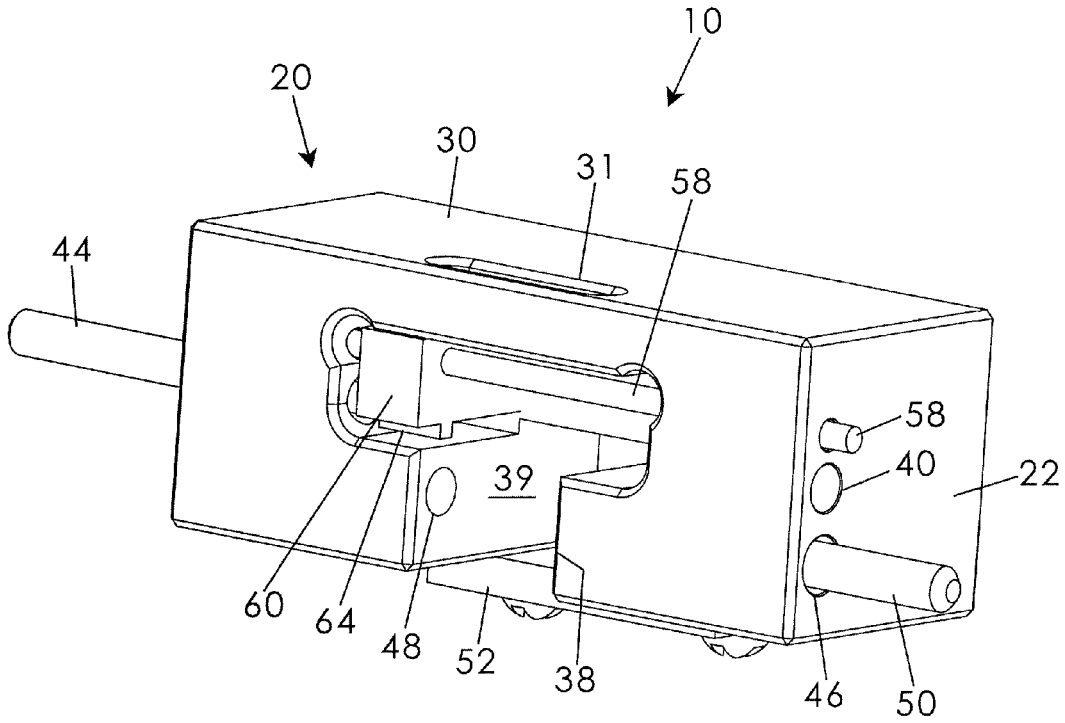
FIG. 6 is another perspective view as in FIG. 1 taken from a lower angle.
Figure 7A:
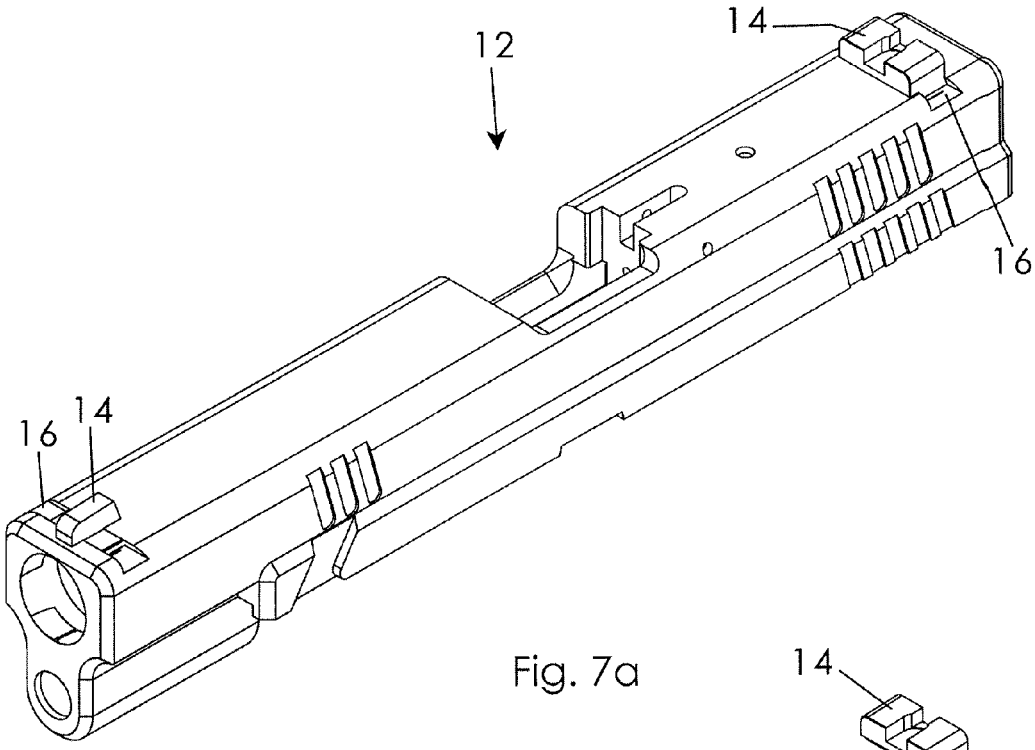
FIG. 7*a* is a perspective view of a gun slide having a sight element mounted at opposed ends.
Figure 7B:
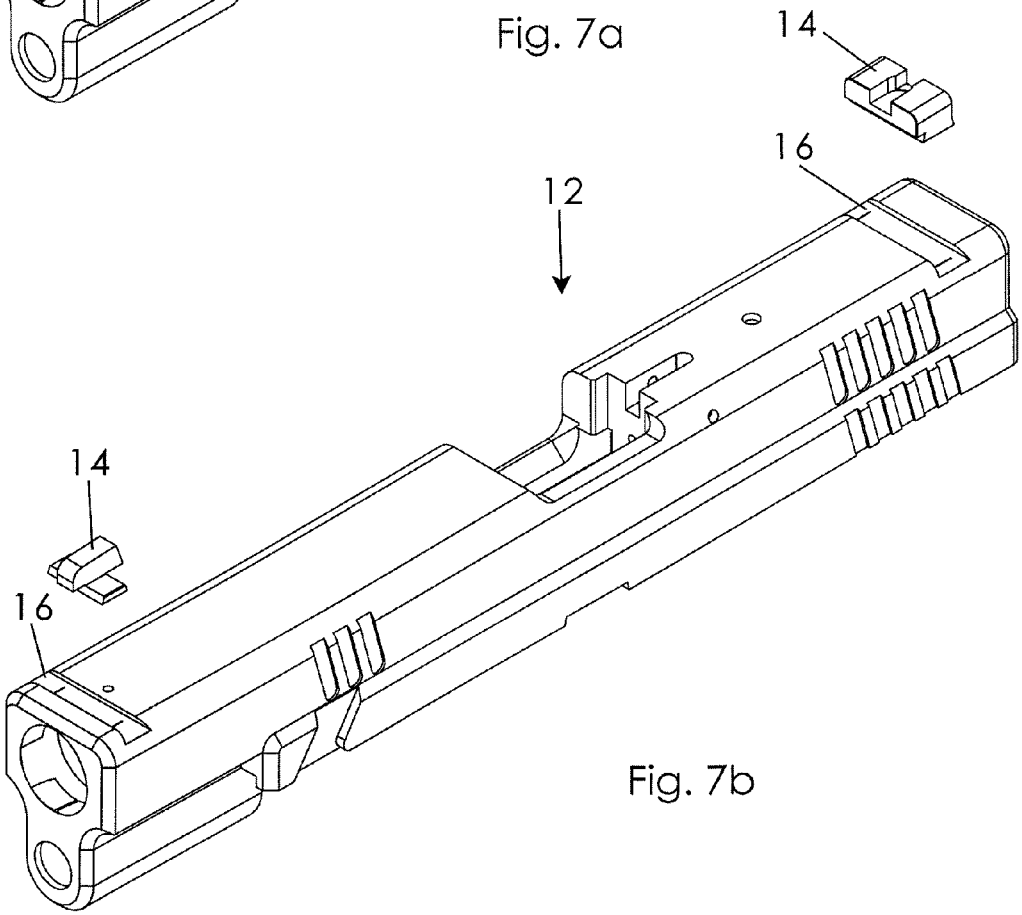
FIG. 7*b* is an exploded view of the gun slide of FIG. 7*a;*

The top wall 30 of the block member 20 defines a slot 31 adjacent an upper edge of the front wall 26, the slot 31 being in communication with the upper cavity 34 of the interior area. The slot 31 enables a user to manually view a gun slide 12 while it is being received into the lower cavity 36 between the first 38 and second 39 internal walls. This is important so as to align the sight element 14 with the jaw member 60 within the upper cavity 34. Further, the jaw member 60 includes an alignment flange 64 extending downwardly from a bottom side thereof, the alignment flange 64 having a configuration that registers with a complementary alignment groove 16 on the gun slide 12 when the gun slide 12 is received in the lower cavity 36 (FIG. 2). All of these structures may be viewed through the slot 31.

Further, the sight pushing apparatus 10 includes a locking plate 52 removably coupled to the bottom wall 32 of the block member 20 with fasteners such as screws. The locking plate 52 is configured to selectively block access to the lower cavity 36 and to block inadvertent removal or movement of the gun slide 12 when the gun slide 12 is received in the lower cavity 36 as described above.

The first bore 40, third bore 42, and fifth bore 54 have entrance openings on the first side wall 22 of the block member 20. The second bore 42, fourth bore 48, and sixth bore 56 have entrance openings on the second side wall 24. The bores themselves, of course, extend into communication with respective cavities of the interior area. Preferably, respective bores are in vertical alignment as shown in the drawings and, particularly, in FIGS. 4 and 8*b*.

In another embodiment (not shown), the block member 20 may be a housing not having a solid construction. The housing may include the exterior walls as described above and have the internal walls that receive a gun slide 12. The housing defines an interior area. The opposed side walls define apertures in the manner of the bore openings described above. The pushing member 44, guide rod 58, and holding member 50 may be inserted through the apertures into the interior area and operate in manner substantially similar to that described previously.

In one embodiment, the block member 20 may define bores on one side but not on the other.

In use, a gun slide 12 may be removed from a handgun in a manner as if the gun slide 12 was to be cleaned. The gun slide 12 may then be positioned and received into the lower cavity 36 of the block member 20 as described above. It is understood that the gun slide 12 may be positioned to adjust either the gun slide's front sight element or rear sight element. The sight element 14 and alignment groove 16 may be properly lined up by the user looking through the slot 31. When properly positioned, the holding member 50 may be inserted into third bore 42 or fourth bore 48 and tightened so as to hold the gun slide 12 against the first internal side wall 38 or second internal side wall 39, respectively.

The guide rod 38 may be inserted through the fifth bore 54 or sixth bore 56 and through the guide channel 62 of the jaw member 60. The guide rod 58, properly positioned, enables the jaw member 60 to move in a level and stable manner when the pushing member 44 is inserted. Namely, the pushing member 44 may be inserted into the first bore 40 or second bore 42, whereby to urge the jaw member 60 to bear against the sight element 14 of the gun slide 12. Increased insertion pressure upon the pushing member 44 will result in movement of the sight element 14, either to adjust its alignment or completely remove it.

It is understood that while certain forms of this invention have been illustrated and described, it is not limited thereto except insofar as such limitations are included in the following claims and allowable functional equivalents thereof.

The invention claimed is:

1. A sight pushing apparatus for use in adjusting the position of a sight element on a gun slide of a handgun, comprising:

a block member, comprising:

opposed exterior first and second side walls and opposed front and rear walls extending between front and rear edges of respective first and second side walls;

opposed top and bottom walls extending between upper and lower edges of said respective first and second side walls;

wherein:

said block member defines an interior area that includes an upper cavity extending between said opposed front and rear walls and a lower cavity extending between said opposed front and rear walls and in communication with said upper cavity and with an area outside said interior area;

said block member includes a first internal side wall and an opposed second side wall situated in said lower cavity and configured to receive the gun slide into said lower cavity between said first and second internal side walls;

the sight element of the gun slide is situated in said upper cavity when the gun slide is received in said lower cavity;

said block member defines a first bore extending from said first side wall into communication with said upper cavity;

said block member defines a second bore extending from said second side wall into communication with said upper cavity;

a pushing member having an elongate configuration selectively received in said first bore or said second bore and being selectively movable therealong into said upper cavity; and a jaw member situated in said upper cavity adjacent the gun side when the gun slide is received in said lower cavity, said jaw member being movable inwardly in said upper cavity when contacted by said pushing member so as to move the sight element of the gun slide as a result;

wherein said jaw member includes an alignment flange extending downwardly from a bottom side thereof, said alignment flange configured to register with a complementary alignment groove on the gun slide when the gun slide is received in said lower cavity.

2. The sight pushing apparatus as in claim 1, wherein:

said block member defines a third bore extending from said first side wall into communication with said lower cavity;

said block member defines a fourth bore extending from said second side wall into communication with said lower cavity; and said sight pushing apparatus further comprising a holding member having an elongate configuration selectively received in said third bore or said fourth bore and movable therealong into said lower cavity so as to press against the gun slide when the gun slide is received in said lower cavity, whereby said holding member prevents the gun slide from moving.

3. The sight pushing apparatus as in claim 2, wherein:

said jaw member defines a guide channel;

said block member defines a fifth bore extending from said first side wall into communication with said upper cavity;

said block member defines a sixth bore extending from said second side wall into communication with said upper cavity;

said sight pushing apparatus includes a guide rod selectively received in said fifth bore or said sixth bore and being selectively movable therealong into said upper cavity and into said jaw guide channel, said jaw guide channel being configured such that said jaw member is slidably movable along said guide rod as said jaw member is pushed by said pushing member.

4. The sight pushing apparatus as in claim 3, wherein:

said first bore, said third bore, and said fifth bore have entrance openings, respectively, on said first side wall that are positioned in vertical alignment relative to one another; and said second bore, said fourth bore, and said sixth bore have entrance openings, respectively, on said second side wall that are positioned in vertical alignment relative to one another.

5. The sight pushing apparatus as in claim 1, wherein said top wall of said block member defines a slot adjacent an upper edge of said front wall, said slot being in communication with said upper cavity such that said gun slide is visible therethrough when received in said lower cavity.

6. The sight pushing apparatus as in claim 1, further comprising a locking plate removably coupled to said bottom wall of said block member and configured to selectively block access to said lower cavity and to block removal of said slide guide when the gun slide positioned in said lower cavity therein.

7. The sight pushing apparatus as in claim 1, wherein said block member includes a generally solid construction.

8. A sight pushing apparatus for use in adjusting the position of a sight element on a gun slide of a handgun, comprising:

a block member, comprising:

opposed exterior first and second side walls and opposed front and rear walls extending between front and rear edges of respective first and second side walls;

opposed top and bottom walls extending between upper and lower edges of said respective first and second side walls;

wherein:

said block member defines an interior area that includes an upper cavity extending between said opposed front and rear walls and a lower cavity extending between said opposed front and rear walls and in communication with said upper cavity and with an area outside said interior area;

said block member includes a first internal side wall and an opposed second side wall situated in said lower cavity and configured to receive the gun slide into said lower cavity between said first and second internal side walls;

the sight element of the gun slide is situated in said upper cavity when the gun slide is received in said lower cavity;

said block member defines a first bore extending from said first side wall into communication with said upper cavity;

a pushing member having an elongate configuration selectively received in said first bore and being selectively movable therealong into said upper cavity; and a jaw member situated in said upper cavity adjacent the gun side when the gun slide is received in said lower cavity, said jaw member being movable inwardly in said upper cavity when contacted by said pushing member so as to move the sight element of the gun slide as a result;

wherein said jaw member includes an alignment flange extending downwardly from a bottom side thereof, said alignment flange configured to register with a complementary alignment groove on the gun slide when the gun slide is received in said lower cavity.

9. The sight pushing apparatus as in claim 8, wherein:

said block member defines a second bore extending from said second side wall into communication with said upper cavity; and said pushing member is selectively received in said first bore and selectively movable therealong into said upper cavity, said jaw member being movable inwardly in said upper cavity when contacted by said pushing member so as to move the sight element of the gun slide as a result.

10. The sight pushing apparatus as in claim 9, wherein:

said block member defines a third bore extending from said first side wall into communication with said lower cavity;

said sight pushing apparatus further comprising a holding member having an elongate configuration selectively received in said third bore and movable therealong into said lower cavity so as to press against the gun slide when the gun slide is received in said lower cavity, whereby said holding member prevents the gun slide from moving.

11. The sight pushing apparatus as in claim 10, wherein:

said block member defines a fourth bore extending from said second side wall into communication with said lower cavity; and said holding member selectively received in said fourth bore and movable therealong into said lower cavity so as to press against the gun slide when the gun slide is received in said lower cavity, whereby said holding member prevents the gun slide from moving.

12. The sight pushing apparatus as in claim 11, wherein:

said jaw member defines a guide channel;

said block member defines a fifth bore extending from said first side wall into communication with said upper cavity; and said sight pushing apparatus includes a guide rod selectively received in said fifth bore and being selectively movable therealong into said upper cavity and into said jaw guide channel, said jaw guide channel being configured such that said jaw member is slidably movable along said guide rod as said jaw member is pushed by said pushing member.

13. The sight pushing apparatus as in claim 12, wherein:

said block member defines a sixth bore extending from said second side wall into communication with said upper cavity; and wherein said guide rod is selectively received in said sixth bore and being selectively movable therealong into said upper cavity and into said jaw guide channel, said jaw guide channel being configured such that said jaw member is slidably movable along said guide rod as said jaw member is pushed by said pushing member.

14. The sight pushing apparatus as in claim 8, wherein said top wall of said block member defines a slot adjacent an upper edge of said front wall, said slot being in communication with said upper cavity such that said gun slide is visible therethrough when received in said lower cavity.

15. The sight pushing apparatus as in claim 8, further comprising a locking plate removably coupled to said bottom wall of said block member and configured to selectively block access to said lower cavity and to block removal of said slide guide when the gun slide positioned in said lower cavity therein.

* * * * *